United States Patent [19]

Anderson

[11] Patent Number: 4,858,262

[45] Date of Patent: Aug. 22, 1989

[54] CONFINED LIQUID FLOTATION MATTRESS

[76] Inventor: Stanley K. Anderson, 3000 Broadway, #9, Boulder, Colo. 80302

[21] Appl. No.: 917,792

[22] Filed: Oct. 10, 1986

[51] Int. Cl.[4] ..... A47C 27/08

[52] U.S. Cl. ..... 5/451

[58] Field of Search ..... 5/451, 450, 449, 452, 5/422, 441

[56] References Cited

U.S. PATENT DOCUMENTS

| | | | |
|---|---|---|---|
| 2,672,183 | 3/1954 | Forsyth | 5/455 |
| 3,456,270 | 7/1969 | Weinstein et al. | 5/451 |
| 3,585,660 | 6/1971 | Gottfried et al. | 5/451 |
| 3,689,949 | 9/1972 | Weinstein et al. | 5/451 |
| 3,803,647 | 4/1974 | Reswick | 5/451 |
| 3,810,265 | 5/1974 | McGrew | 5/451 |
| 3,849,814 | 11/1974 | Ross | 5/451 |
| 4,040,133 | 8/1977 | Gilreath | 5/451 |
| 4,583,254 | 4/1986 | Johenning et al. | 5/451 |
| 4,611,357 | 9/1986 | Chelin | 5/451 |

FOREIGN PATENT DOCUMENTS

| | | | |
|---|---|---|---|
| 550650 | 5/1932 | Fed. Rep. of Germany | 5/450 |

*Primary Examiner*—Alexander Grosz

*Attorney, Agent, or Firm*—Donald W. Margolis

[57] ABSTRACT

A flotation mattress is provided in which the downwardly directed weight of the user's body on the top wall of the mattress is counter-balanced substantially only by a force directed vertically upward by the buoyancy force of the liquid in the mattress, and not by any substantial tension or tautness in the top wall of the mattress. The top wall of the mattress is of sufficient surface area to conform to and envelop a user while still keeping him or her dry. A liquid which is more dense than water, such as salt water may be used in the mattress. The liquid in the mattress, in conjunction with the excess top wall material which yields substantially completely beneath the user's body, strongly simulates flotation in a liquid. The amount of excess top wall material will be selected in such a manner that when the mattress is filled with the proper amount of liquid and a user assumes a supine position on the top wall, the top wall will have both a sufficient length dimension and a sufficient width dimension to substantially completely yield beneath the users body without the top wall itself providing substantial support to the user. In one embodiment of the present invention, the confined liquid mattress is placed on a horizontal internal surface within an isolation enclosure constructed of light weight prefabricated panels, which enclosure provides a space in which a user may recline comfortably in a dry flotation environment.

19 Claims, 3 Drawing Sheets

CONFINED LIQUID FLOTATION MATTRESS

FIELD OF THE INVENTION

The present invention relates to a flotation mattress having a confined liquid, and to the details of such a flotation mattress. It also relates to the use of such a flotation mattress in an isolating enclosure having a horizontal internal surface for supporting such a mattress.

DISCUSSION OF THE PRIOR ART

Flotation tanks, which are popularly used to induce relaxation, are usually enclosed in sound and light isolating enclosures, although the quality of the sound isolation is generally quite poor. Such tanks are normally filled with warm salt water because salt water provides greater buoyancy to a user than fresh water. However, many users find that relaxation while floating in a salt water tank is inhibited or difficult because they feel that they must hold their necks tight and shoulders rigid to avoid getting salt in their eyes or mouth. This is a real concern because salt water stings the eyes, and at the concentration needed for flotation, if imbibed, can be unhealthy to a user. Furthermore, flotation in salt water has other shortcomings. For example, when exposed to salt water even the slightest blemish, sore or cut which a user may have may cause the user to experience a painful or stinging sensation. Users of salt water flotation systems also sometimes experience a crusting of salt along the water line of their bodies as they float, salt water has a tendency to dry a user's skin. The humidity from the warm water tank can condense on the ceiling of the enclosure and drip on a user's face or even in a user's eyes.

The cost of operating a flotation tank is high. The salt water must be recirculated regularly, and chemicals must be added, or expensive ultraviolet/ozone purifiers must be used daily to prevent the growth of bacteria and algae in the salt solution. Showers and hot water must be provided, because of the user's need to shower before and after each use. Salt water from the flotation tank drips on the floor and must be promptly cleaned or it is likely to corrode, stain or otherwise damage the floor. The room and building in which a flotation tank is located must also be built to handle the humidity generated by the water in the tank, for example, by the installation of vents, fans, dehumidifiers and/or air conditioners. Furthermore, commercial flotation tank and hot tub establishments have experienced a decline in usage in recent years which is attributed to the public's fear of catching diseases from exposure to water used by anonymous third parties.

There are other problems associated with isolating enclosures used with flotation tanks. One such problem centers around the ability to make a vibration and light isolated enclosure from inexpensive, prefabricated components, which components are also sufficiently lightweight for ease of shipment and assembly. The details of one such preferred enclosure are set forth in copending U.S. patent application Ser. No. 917,791, filed Oct. 10, 1986, for "ISOLATING ENCLOSURES AND COMPONENTS THEREOF," by Stanley K. Anderson.

The use of traditional waterbed mattresses in place of flotation tanks is not known to be practiced. However, even if they have been, it would be found that, despite the use of the term "flotation" in some of their names and advertisements, existing waterbed mattresses do not provide true flotation. In general, the public expects or requires such waterbed mattresses to be substantially more yielding than standard mattresses while at the same time providing substantial support to the user. Standard waterbed mattresses support the user's body on a substantially taut top wall. As a result, such mattresses provide support which is more like being on the taut, surface of a hammock, or on the non-expanding surface of an inflated bag or balloon than floating in water. The top wall of such a mattress yields somewhat where it is pushed or weighted by a user's body, primarily at the user's buttocks and shoulders. The resulting displacement of fluid creates upward pressure which is resisted by the top wall of the water mattress. This results in inner upward pressure on other portions of the top wall of the mattress, which pressure in turn creates tension in the top wall of the mattress so that the top wall presses against and supports other portions of the user's body. As a result, users do not really float on the top wall of a standard waterbed mattress, but rather, the fluid and the top wall material of such a mattress operate to provide a taut topwall which support a user on the surface unevenly from below. Because of this, there will always be pressure points where the top wall of a standard waterbed mattress actually contacts and supports the prominences of a user's body. For example, when a person lays in a supine position on the top wall of a standard waterbed mattress, these pressure points will tend to be at the heels, the buttocks, across the shoulder blades and at the back of the head. The body will not be supported on the top wall of a standard waterbed mattress with as great a pressure at the achilles tendons, around the backs of the knees, at the small of the back, and at the neck.

In the prior art, Johenning, et al., U.S. Pat. No. 4,583,254 discloses a "low tension" waterbed mattress having a top with a plurality of expandable folds which allow the top wall to stretch and expand from about 3% to as much as 20%, primarily in the width dimension, when a user lies on the mattress. In general, the top wall of the mattress of this reference is defined as having a surface area of from about 3% to as much as 20% greater than the surface area of the bottom wall of the mattress. This reference further discloses that the ratio (percentage) of the excess surface area of the top wall to the bottom wall is preferably less than 1.5 (50%), since at ratios greater than 1.5 the user can bottom out. Additionally, it teaches that the sum of the length and the width of the excess top wall is at least 5 inches (12.25 cm) greater than the sum of the length and the width of the bottom wall, and is generally no more than 20 inches (29 cm), and preferably no more than 10 inches (24.5 cm) greater than the sum of the length and the width of the bottom wall. Thus, while this reference teaches a waterbed mattress structure which provides a top wall which is larger than the bottom wall, and which therefore provides somewhat greater yielding of the top wall than a standard waterbed mattress, it can not provide a true flotation experience. As will be detailed below, the amount of excess surface area in the top wall of this prior art mattress is not sufficient to allow most users to truly float without the constraint and pressure of the mattress top wall holding up portions of the user's body. Furthermore, this reference provides no teaching of what is required to provide true flotation.

A reduced depth and size dry flotation system which uses containers having cavities generally contoured to the shape of the human body, which cavities contain a fluid impermeable bag, have been taught in Weinstein, et. al. U.S. Pat. No. 3,689,949. Such systems are intended for use by bed-ridden patients who have to maintain a substantially motionless position for prolonged periods of time. The bag is composed of a lower sheet which covers the base of the cavity and an upper sheet which is larger than the lower sheet. The bag is filled with less liquid than its volume, and as shown by the figures, includes entrapped air. When a user assumes a supine position on the bag, the bag deforms around the contours of the user's body. When a patient is placed on such a bag, the fluid in the bag is displaced until it fills the bag, and the fluid filled bag then effectively acts as a water and air filled "balloon" or bag to support the patient. That actual flotation does not take place on the bag, but that a balloon effect occurs, is evidenced by the fact that the reference teaches that the bag can be filled with fluid "less than the weight of the floating patient", and that support of the patient will occur "when about two-thirds of his body sinks below the surface of the water". Since flotation involves the displacement of a weight of fluid equal to the weight of the floating body, it is seen that true flotation does not occur on the bag of this reference, and that a patient does not float in the same manner as in a flotation tank. Rather the patient's body is apparently supported by a counter-balancing combination of buoyancy force and the ballooned stress forces in the upper sheet, which ballooned stress forces are apparently derived from the liquid and air tensioned top cover of the bag. Additionally, the patient's motion is severally limited by the shape of the contoured cavity in the container.

SUMMARY OF THE PRESENT INVENTION

It is therefore an object of the present invention to provide a system which allows a user to experience a true flotation experience without exposure to water, salt water or public water.

It is another object of the present invention to provide a confined liquid mattress which provides a true flotation experience to a user.

It is yet another object of the present invention to provide a confined liquid flotation mattress for use in an isolating enclosure in place of a flotation tank.

In the ideal situation, using the flotation type of confined liquid mattress of the present invention, the downwardly directed weight of the user's body on the top wall at any point along the body is counter-balanced substantially only by a force directed vertically upward by the buoyancy force of the liquid in the mattress, and not by any substantial tension or tautness in the top wall of the mattress. Therefore, for a user to really float on water or on the top wall of a confined liquid mattress, the user's body must displace a volume of fluid having a weight equal to the user's weight. The human body, but for the air in the lungs, has substantially the same density as, or a slightly greater density than water. Therefore, in fresh water or on a waterbed filled with fresh water most or all of a person's body must sink into the water or into the surface of the top wall of the mattress so that it can displace substantially its own volume of fresh water in order to displace its weight and float.

In the practice of the present invention the mattress system is somewhat similar to that of a traditional waterbed mattress, except that the top wall is very loose, and is not taut like the top wall of a standard waterbed mattress.

In the use of the mattress of the present invention, the user floats on the loose top wall surface of the mattress, preferably on a sheet, suspended in and above liquid confined in the mattress. In preferred embodiments a liquid which is more dense than water, such as salt water having a specific gravity greater than 1.0, is used in the mattress. The use of liquids having a specific gravity greater than 1.0 allows substantially complete flotation of a user without requiring total submersion of the user's body into the mattress. This in turn avoids a need for excessive depth for the mattress.

The top wall of the mattress is composed of a loose membrane, for example, of thin, strong, substantially water-proof synthetic polymeric material, of sufficient surface area, as detailed below, to conform to and envelop a user while still keeping him or her dry. The liquid in the mattress, in conjunction with the excess top wall material which yields substantially completely beneath the user's body, strongly simulates flotation in a liquid. The system, for example, allows a user to rest evenly on his or her back with the arms, legs and shoulders on the top cover of the mattress, but substantially below the level of the liquid in the mattress, very much in the same manner as they would be if the user were actually floating in the liquid with no intervening top wall present. The user's achilles tendons, the back of the knees, small of the back and neck are supported as evenly from underneath as are the heels, buttocks, shoulders, and head. As in a flotation tank, the user's feet can easily sink below the level of the confined liquid in the mattress. The user's buttocks can sink and yet the small of the back is supported evenly, with virtually no tautness, tension, or pressure from the top wall of the mattress. The user's shoulders can sink below the level of the liquid, allowing full support for the user's neck without applying pressure or tension to the head. The user can also rest comfortably on his or her side or front if he or she so chooses, and have a similar flotation experience. When the mattress is filled with temperature controlled liquid, as it normally will be when the top wall of the mattress closes around the user, the user will warm quickly if he or she is cold, and cool quickly if warm.

In the practice of the present invention, the amount of excess top wall material will be determined and selected in such a manner that when the mattress is filled with the proper amount of liquid and a user assumes a supine position on the top wall, the top wall will have both a sufficient length dimension and sufficient width dimension to substantially completely yield beneath the users body without the top wall itself providing substantial support to the user. This results in the portion of top wall beneath the user's body being able to displace a volume of liquid in the mattress which has a weight which is substantially equal to the user's weight so that the user experiences a substantial flotation experience.

In one embodiment of the present invention, the confined liquid mattress is placed on a horizontal internal surface within an isolation enclosure constructed of light weight prefabricated panels, which enclosure provides a space in which a user may recline comfortably in a dry flotation environment.

For a fuller understanding of the nature and objects of the present invention, reference should be made to the following detailed description taken in conjunction with the accompanying drawings.

BRIEF DESCRIPTION OF THE DRAWINGS

The accompanying drawings illustrate complete preferred embodiments of the present invention according to the best modes presently conceived for the practical application of the principles thereof, and in which.

DETAILED DESCRIPTION OF THE INVENTION

Figure 1:
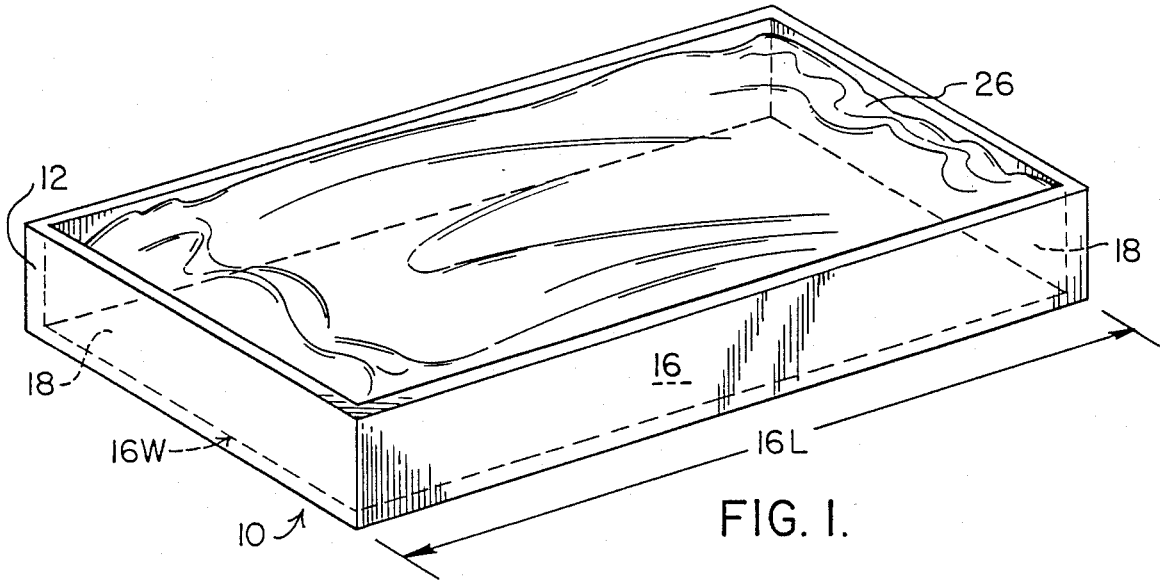
FIG. 1 is an isometric view, partially in phantom, of a confined liquid mattress system, according to the present . invention in a frame.
Figure 2:
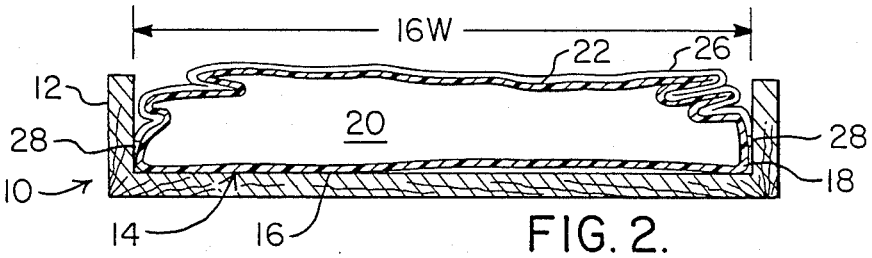
FIG. 2 is a transverse sectional view of the mattress and frame of FIG. 1 taken along line 2—2 of FIG. 1.

Referring to FIGS. 1 and 2, a so called "waterbed" system 10 including an essentially rigid frame 12 and the confined liquid mattress 14 of the present invention is shown. In use, rigid frame 12 is of a length and of a width to confine mattress 14 of the present invention and to receive a user. Confined liquid mattress 14 of the present invention is constructed, in general, of a substantially water-proof, non-expanding material which is of sufficient thickness and durability to allow contact from a user and also to resist substantial stretching. It is common practice in the confined liquid mattress industry to utilize 20 mil thick polyvinylchloride (PVC) sheet material to construct such a mattress, although in the practice of the present invention, about 10 to 15 mil polyurethane has been found to be both suitable and in some instances, preferable for such use. Other suitable and well known polymeric materials may also be utilized for this purpose as well, which materials are preferably substantially non-expanding and non-stretching. Mattress 14 is in no way secured to frame 12, and is preferably not so secured.

The definition of, and the relative dimensions of the various portions of mattress 14 are critical to the understanding and the definition of the present invention. Referring again to FIGS. 1 and 2, mattress 14 has a bottom wall 16, shown in phantom, having an "effective" length dimension 16 L and an "effective" width dimension 16W. Bottom 16 and its "effective" dimensions are either defined by an actual rectilinear planar bottom wall portion 16, or lacking such a portion, for example, in the embodiment shown in FIG. 3, will be substantially defined as the length and width of frame 12 which confines liquid mattress 14. Mattress 14 will also have "effective" side walls 18. Side walls 18 will either be defined by planar side wall portions of mattress 14, or lacking such side wall portions, they will be effectively defined by the height of liquid 20 in the mattress. Finally, and most significantly for the practice and the understanding of the present invention, the confined liquid mattress of the present invention will have a top wall 22. Top wall 22 has an "effective" length dimension greater than the "effective" length dimension 16L of bottom wall 16 and an "effective" width dimension greater than the "effective" width dimension 16W of bottom wall 16. Since the "effective" length dimension and the "effective" width dimension of top wall 22 is illustrated as either a complex fold in FIGS. 1 and 2, or as part of a bag in FIG. 3, or in use in FIG. 4, or folded in FIGS. 5 and 6, its relative planar dimensions cannot be shown.

As detailed herein, the effective dimensions of top wall 22 will be determined and selected in such a manner that when mattress 12 is substantially filled with confined liquid and a user assumes a supine position on top wall 22, top wall 22 will have sufficient effective length dimension and sufficient effective width dimension to substantially completely yield beneath the users body without top wall 22 itself providing any substantial support to the user. This results in the portion of top wall 22 beneath the user's body being able to displace a volume of liquid 20 which has a weight which is substantially equal to the user's weight so that the user experiences a substantial flotation experience. Therefore, the downwardly directed weight of the user's body on top wall 22 at any point along the user's body is counter-balanced substantially only by a force directed vertically upward by the buoyancy force of liquid 20 against the inner surface of top wall 22, and, because of the excess length and width of the top wall, not by any tension or tautness which is provided by top wall 22. Additionally, mattress 14 will normally be provided with an appropriate inlet and outlet port, not shown, for introduction and drainage of liquid 20 to and from mattress 14.

As in prior art systems, and of utility in the present invention, liquid 20 will typically be water supplied from any tap or other common source. In the preferred practice of the present invention, materials will be added to the water or to the liquid 20 otherwise selected which will provide a solution having a specific gravity measurably greater than water. Water normally has a specific gravity of 1.0. By utilizing a liquid having a specific gravity greater than 1.0, a greater weight of the liquid is displaced, per volume, by the user and thus a mattress having less "effective" sidewall depth will be required in order to provide a flotation experience. As is also detailed below, in most instances an aqueous solution having a specific gravity of about 1.1 will be sufficient to provide substantially full flotation with top wall cover 22 of mattress 14 having an effective sidewall depth of only about 8 to about 10 inches (20–25 cm). Such density is easily and inexpensively achieved with the addition of common salt (sodium chloride) to ordinary water. Utilizing sodium chloride, aqueous saline solutions having densities of as great as about 1.25 can be easily and economically achieved. Where greater densities are desired, say about 1.34, common, inexpensive and more soluble materials having greater specific gravity than salt, such as epsom salts (magnesium sulfate), can be utilized. Similar and/or other specific gravities of the liquid can be achieved utilizing other salts in aqueous solution, with the amounts required and the solubilities of the additives being easily determined utilizing data readily available from handbooks and using routine density calculations. While not as practical or economical as the addition of inorganic salts to water, other dense liquids, including certain hydrocarbons, can also be utilized for equivalent purposes in the practice of the present invention to achieve specific gravities of 2, 3 or more.

The liquid 20 may be injected into mattress 14 either prior to or after the addition of density increasing ingredients, together with any other desired additives. Where water soluble salts and water are utilized, little mixing or agitation is required to place them into solution throughout the aqueous medium as the salts will readily dissolve, to the full extent of their solubility, and disperse themselves throughout the solution. As an alternative, the solution 20, say of salt, can be pre-mixed to the desired density and then injected into the mattress 14.

Mattress 14 can be provided with sheets 26 that extend over the central portion of top wall 22. Sheets 26 can be attached to top wall 22 by fasteners 28, such as those of the hook and loop type sold under the trademark of Velcro. Other types of fastening arrangements, including hooks, snaps, buttons, ties and so on may also be utilized for the purpose of securing sheets to top wall 22. Sheets are desirable for use with the flotation mattress of the present invention as they keep the user comfortable, by keeping his or her skin out of direct contact with the polymeric material of the top wall, and as they also provide a simple means for maintaining clean and hygienic conditions in the use of the mattress of the present invention.

Referring again to FIG. 1, top wall 22 of mattress 14 may be, and preferably is, formed of smooth material. The excess material in the top wall 22 can either be folded or urged to the sides of the top wall when not in use, as shown most clearly in FIG. 2, or the excess top wall material can be otherwise stored, as detailed below in the discussion of FIG. 6.

Now, defining the relationship between the length and width dimensions of top wall 22 and the area of top wall 22 and the remainder of mattress 14, and especially in relationship to bottom wall 16 of the mattress, requires several considerations and points of reference. First, it is clear that top wall 22 cannot be defined as a simple ratio or percentage of top wall 22 to bottom wall 16 because such ratios and percentages are as much a function of the various mattress bottom wall sizes as they are of the excess length and width dimensions of top wall 22 which are required to allow true flotation. It is also clear that it cannot be defined as the sum of the additional length and width of top wall 22 compared to the sum of the length and width of bottom wall 16, because such a definition would allow all of the excess material to be located in only one dimension, while the operation of the present invention, as set forth in greater detail below, requires a minimum amount of excess material in each of the length and the width dimensions.

Figure 4:
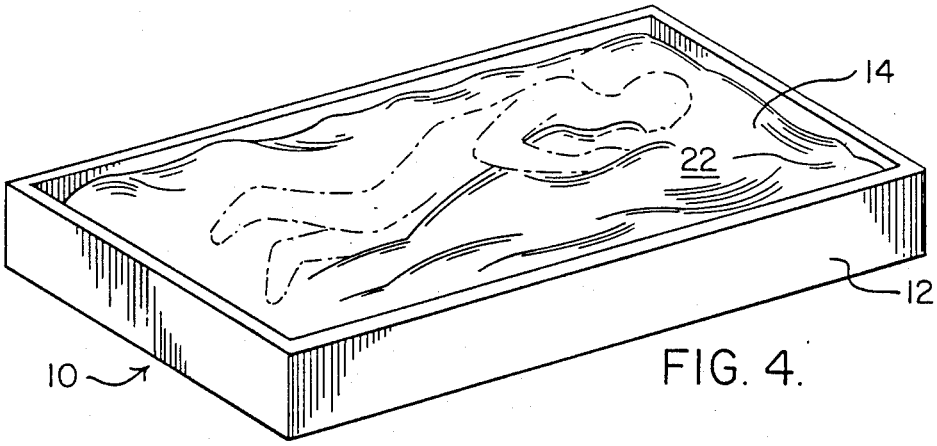
FIG. 4 is similar to FIG. 1, but illustrates the top wall of the mattress as it would be configured when occupied by a user, illustrated in dashed lines, on his side.

In the simplest implementation of the present invention, that of a mattress for use by a single user having a specific gravity of about 1.0 and a maximum torso thickness of from about 6 inches (15.25 cm) to about 14 inches (35.5 cm), the amount of excess top wall 22 required in a mattress 14 containing a liquid 20, which liquid has a specific gravity of about 1.0, will be determined in approximately the following way. First, for real flotation to occur, when the user assumes a supine position on top wall 22 the user will effectively have to displace his or her weight of liquid 20 in order to float. But since top sheet 20 is intermediate the user and the liquid, the user's body will effectively have to force an amount of top sheet 22 having a surface area equal to what would be the submerged surface area of the user, into liquid 20. Now, assuming that a user in a supine position having a specific gravity of about 1.0 on a liquid having a specific gravity of about 1.0 will sink to the full depth of the thickest part of his or her torso, say from about 6 inches (15.25 cm) to about 14 inches (35.5 cm), an amount of top wall 22 equal to the sum of about the width of the user plus about twice the maximum thickness of the torso, in both the length and the width dimension, i.e., one thickness for each of the user's two lateral sides and one thickness for both the longitudinal head and foot thicknesses, will be forced into liquid 20. At the same time, the amount of top wall 22 beneath the width of the user will be the substantially the same, whether the top wall sinks into the liquid or not, and will not require any substantial additional top wall. Therefore, the amount of additional top wall required for flotation will only be about twice the maximum thickness of the torso, but that additional top wall will be required in both the length and the width dimension, or minimums of about 12 (15.5 cm) to about 28 inches (71 cm) of both additional length and width. It is of interest that the sum of the minimum excess length and width dimension is about 24 inches (31 cm) to about 56 inches (142 cm). Such minimum amounts of excess surface will allow top cover 22 to extend around, for example, the feet, the head, both sides of a user who lies flat and holds his or her legs together with arms closely to the side. It will be readily apparent that in the use of the mattress of the present invention in situations where a user allows his or her legs to be separated and their arms to be spaced from their body, the amount of additional top wall 22 required to envelop them while displacing an amount of liquid 20 equal to their body weight increases substantially, for example, on the order of two or three times more width dimension, plus some additional length dimension. In preferred embodiments there will be added to this a requirement an amount of excess top wall 22 which will allow a user to extend his or her arms above the head and/or then roll themselves into a fetal position on their side, as shown in FIG. 4, all the while moving portions of top wall 22 with their body, without any substantial shear force between it and their skin. In this latter situation it will be seen that the total excess length and width amounts of top wall 22 will be increased significantly and, in effect, has no real top limit. However, as noted above, for purposes of practical definition, in preferred embodiments the minimum length dimension will have about 24 inches (61 cm) to about 52 inches (142 cm) excess length, while the width dimension will have about 36 inches (91.4 cm) to about 72 inches (183 cm) excess width.

In the preferred use of the present invention, liquids having specific gravities greater than 1.0 will be used in mattress 14. So, for example, using a liquid such as salt water having a specific gravity of 1.1 in the mattress, only about 91% submergence of the user's torso will be required for flotation, and thus less excess top wall material will be required. Similarly, using a saturated salt water solution having a specific gravity of about 1.25, or a saturated aqueous epsom salt solution having a specific gravity of about 1.34 in mattress 14, less submergence of the user will be required for flotation and thus less excess top wall material 22 will be required. Should a liquid having a specific gravity of 2.0 be used in the mattress only about 50% submergence of the user's torso will be required for flotation, and thus from as little as about 6 inches (7.75 cm) additional length and width to about 26 inches (66 cm) excess length and about 36 inches (91.4 cm) excess width top wall material will be required. Where two people use the mattress simultaneously the top wall 22 will have to have about twice as much excess width and some additional increment in length for both users to experience flotation. The users will not tend to roll together, as they would from the hills and valleys created by two users on a conventional waterbed mattress, due to the large amount of excess top wall 22 which will permit independent floating. Using other liquids in the mattress, which liquids have greater or lesser specific gravity, or smaller or larger individuals, will effect the amount of submergence required for flotation, and thus the amount of excess top wall material. However, regardless of the number of users, the specific gravity of the liquid used, or the torso size of the user, there will have to be both excess length and excess width material in top wall 22 for there to be a true flotation experience as taught by the present invention. Examples of the amount of excess top wall for various combinations of mattress sizes, users, and liquids with different specific gravities can be readily determined.

From the foregoing it will also be understood why the amount of excess top wall 22 cannot be readily defined as a ratio or as a percentage of the surface area of the bottom wall 16. It will be similarly understood why it cannot be defined only as the sum of the additional length and width of top wall 22 compared to the sum of the length and width of bottom wall 16, since the operation of the present invention, as explained above, requires a minimum amount of excess material in each of the length and the width dimensions.

While a smooth top cover 22 is desired, it would be possible, with some variations, to utilize a folded expandable top wall such as that taught in U.S. Pat. No. 4,583,254. However, the ability to provide sufficient folds to provide all of the excess top cover required by the present invention, and also the ability to provide expansion in the length dimension as well as in the width dimension make the application of the teaching of this prior art somewhat impractical by itself.

It is inherent that the mattress taught by the present invention will have a fluid capacity greater than the amount of liquid in the mattress, due to the amount of excess area of top wall 22. In practice, this excess capacity is not filled with liquid. Rather, mattress 14 is filled to its effective sidewall depth and then, unlike U.S. Pat. No. 3,810,265, is manipulated to remove substantially all excess air. Thus, for example, in preferred embodiments the confined liquid mattress of the present invention is designed to have an effective depth of about 9 inches (23.9 cm), but has the potential capability, if filled to the full capacity of the top cover of having a depth of at least 15 inches (38 cm) or greater, with the top of the mattress bulging or forming a dome above the effective side walls. Such excessive filling with liquid is contrary to the intent and teaching of the present invention and is to be avoided.

Figure 3:
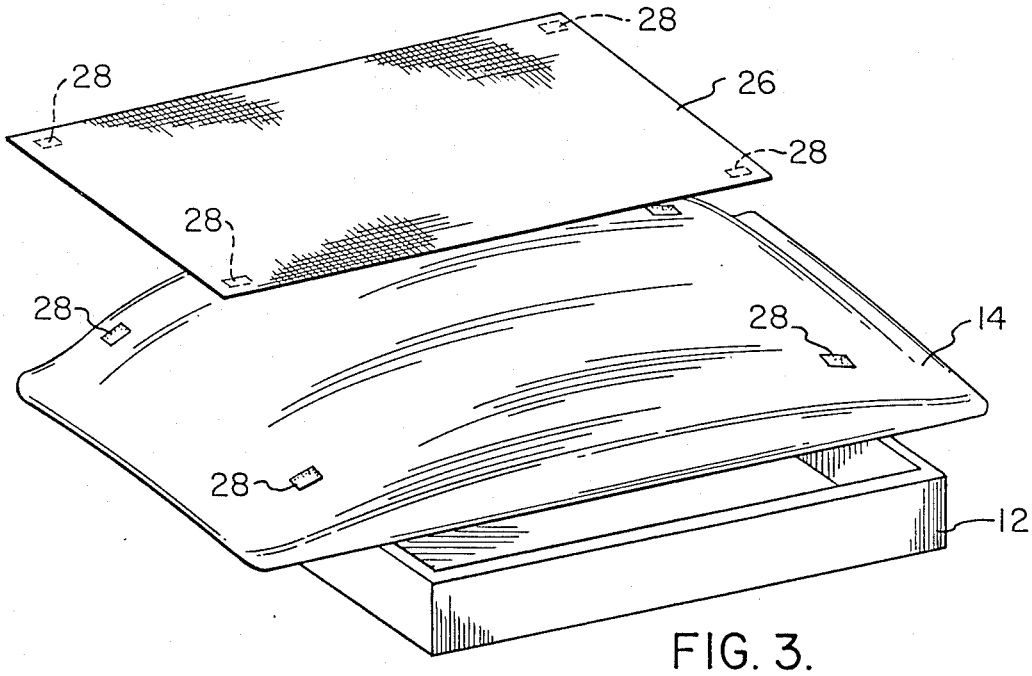
FIG. 3 is an isometric view, showing a preferred embodiment of the mattress of the present invention in an exploded view with respect to a frame and a sheet.

Mattress 14 can be formed in any number of suitable ways. In one preferred embodiment, and as shown in FIG. 3, it can be formed from a single rectilinear sheet, or from a plurality of sheets joined together to form a single sheet. Where a single sheet is used, the longitudinal edges are first brought together and continuously bonded, so that the sheet assumes the form of a band. Then each open end of the band is sealed to form a bladder 30. Referring to FIG. 3, for such a bladder the effective dimensions of bottom wall 16 are defined by frame 12 in which it is located, and the effective height of side walls 18 are defined by the height of liquid 20 in the mattress. The mattress 22 can also be formed by bonding a first planar sheet 16, representing the bottom wall dimensions, to a second larger planar sheet which will provide both the effective side walls 18 and top wall 22. Mattress 14 may also be formed from a first planar sheet representing bottom wall 16, a side wall 18 which is attached to the bottom wall 16 and closed to form a sidewall enclosure, and a second planar sheet representing top wall 22. In any event, any of these structures will come within the purview and practice of the present invention so long as they provide the requisite amount of excess top wall as explained herein and defined in the claims below.

Figure 7:
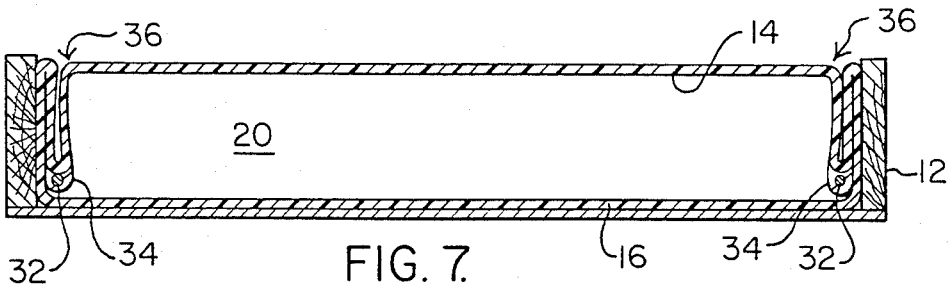
FIG. 7 is a transverse sectional view of the mattress and frame of FIG. 5 taken along line 6—6 of FIG. 5.
Figure 6:
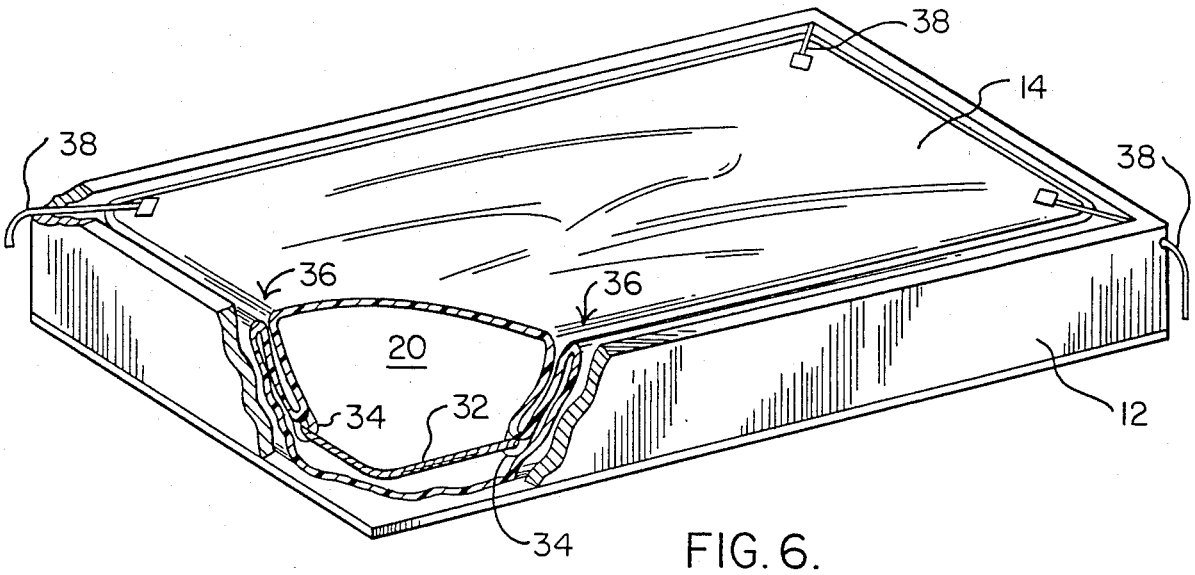
FIG. 6 shows an isometric view of a modified form of the confined liquid mattress with the frame and mattress of the present invention partially broken away, and in which are illustrated means for maintaining the central portion of the top cover of the mattress smooth and taut when it is not being used.

It is both practically desirable and aesthetically pleasing to maintain top wall 22 of the confined liquid mattress of the present invention in a substantially smooth state when the mattress is not being used. Referring to FIGS. 6 and 7, in one modified embodiment of the present invention, the inner surface of the top wall 22 of mattress 22 carries a flexible line or "rope" 32 of weighted material, continuous or intermittent, in a channel 34 near and evenly spaced from its top wall perimeter. The surface portion of top wall 22 circumscribed by this weighted perimeter is thus normally maintained smooth, while excess surface material is neatly held in troughs 36 created within the mattress by weights 32.

As also shown, a plurality of corner pulls 38 may be used in the present invention to cause either the form of top wall illustrated by FIGS. 6 and 7, or a top wall without a weighted smoothing system, to be pulled and drawn into a substantially smooth surface when not being used, to provide the aesthetic appearance of a normal flat mattress.

Figure 5:
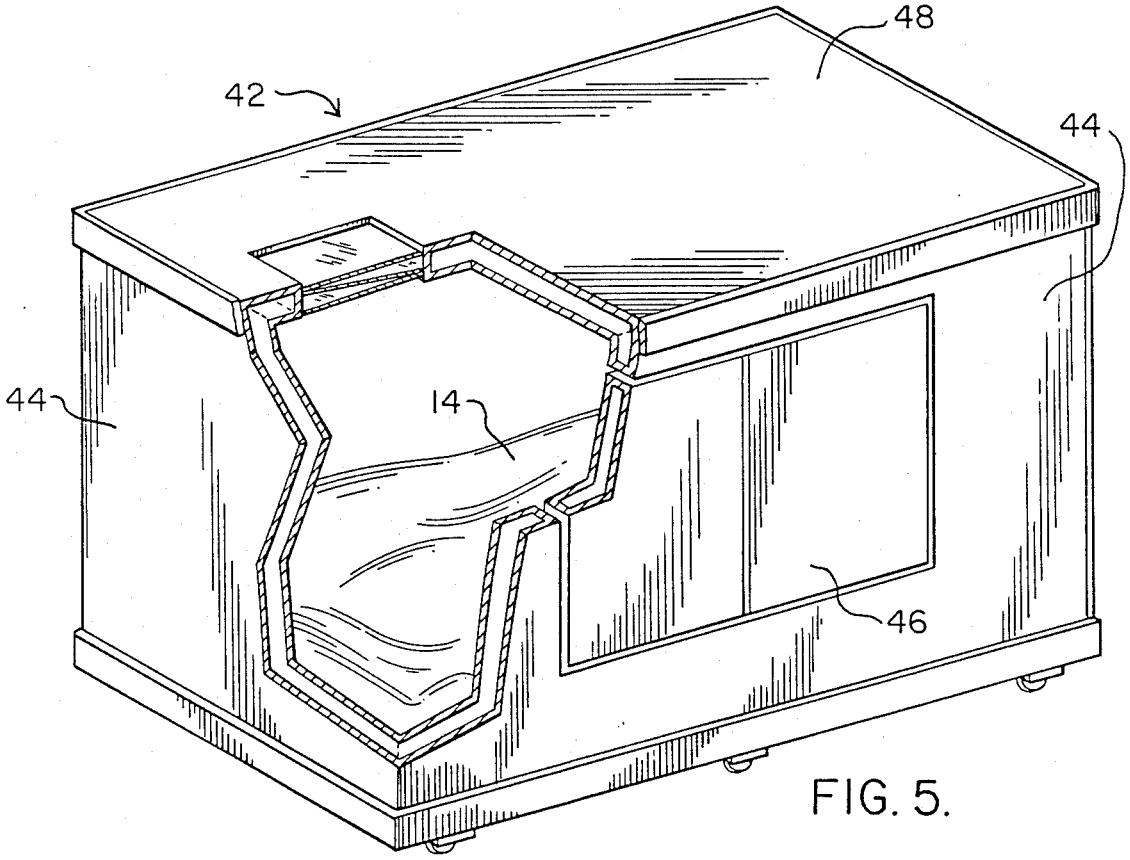
FIG. 5 an isometric view, showing the mattress of the present invention in a partially broken away enclosure.

Referring now to FIG. 5, the mattress of the present invention can be used in an isolating enclosure on a horizontal internal surface. The details of one preferred embodiment of such an isolating enclosure, fabricated from inexpensive sound-isolating, portable panels are set forth in copending U.S. patent application Ser. No. 917,791, filed Oct. 10, 1986, for "ISOLATING ENCLOSURES AND COMPONENTS THEREOF," by Stanley K. Anderson. The system shown in FIG. 5 provides a vibration and light isolating enclosure 42 having an inner chamber including the flotation mattress 14 of the present invention. As set forth in greater detail in the copending application, enclosure 42 is constructed of a plurality of prefabricated rectilinear hollow panels, including sidewall panels 44, one of which includes doors 46, roof panel 48, and a floor panel, not shown. Such initially hollow panels can be easily shipped, and then easily assembled into enclosure 42. Once in place or ready to be set in place the hollow portions of the panels are filled, through fill holes not shown, with inexpensive, readily available particles of high-mass vibration-isolating material, such as sand, metal shot, or inexpensive granular minerals. The high-mass material adds greatly to the mass of the panel and thus to the sound-isolation quality of the panel. When it is desirable to disassemble the enclosure and move the sound-isolation panels the high-mass particles can be drained or removed through drain holes in the panels, and the panels are once again sufficiently light weight to be easily handled, moved and shipped.

In a light and vibration isolated space, such as enclosure 42 containing mattress 14 of the present invention, a user may recline and float his or her body comfortably in a dry environment. Thus the mattress system of the present invention, when located in isolating enclosure 42, allows the user to enjoy the full bodied suspension of floating in a wide variety of relaxed positions without immersion in water or salt water. Use of such a mattress 14 of the present invention in an isolating enclosure can provide a user with relaxation and stress reduction, and concomitant therewith, pain reduction, lower blood pressure, increased awareness, an enhanced therapeutic environment, quiet personal time, deep sleep and an enhanced sense of well being.

It will thus be seen that the mattress of the present invention has significant advantages. It provides a system which allows a user to experience a true flotation experience without exposure to water, salt water or public water. It provides a confined liquid mattress which provides a true flotation experience to a user. It also provides a confined liquid flotation mattress for use in place of a flotation tank in an isolating enclosure. It can also be located in any room without the high humidity impact of a flotation tank. Additionally, when utilized by two people, due to the large amount of excess top wall the users do not tend to roll together into the valley created by the heavier user, as is the common experience on commonly utilized water mattresses. The flotation system of the present invention can be maintained with a bottle of waterbed conditioner and a regular change of sheets.

While the invention has been particularly shown and described with reference to preferred embodiments thereof, it will be understood by those skilled in the art that the foregoing and other modifications or changes in form and details may be made therein without departing from the spirit and scope of the invention as claimed, except as precluded by the prior art.

The embodiments of the invention in which an exclusive property or privilege is claimed are defined as follows:

1. A confined liquid mattress for providing a reclining adult user with a substantially true, total body flotation experience with substantially unrestricted movement, said mattress having a bottom wall having an effective length and an effective width dimension, and effective sidewalls for providing an effective depth dimension and a top wall having an effective length dimension and an effective width dimension, said mattress being designed and adapted to be contained within a generally rectangular support structure having a substantially planar bottom and adapted to be usable in an isolating enclosure, wherein the improvement comprises:

said mattress having a generally rectangular shape when contained within a generally rectangular support structure having a substantially planar bottom, said mattress not requiring a connection to such a support structure in order to provide an adult user with a true flotation experience;

said effective length dimension of said top wall of said mattress being substantially greater than the effective length dimension of said bottom wall, and said effective width dimension of said top wall being substantially greater than the effective width dimension of said bottom wall, said combined length and width dimensions of said top wall being sufficient to provide a total top wall area which can completely yield beneath and completely conform to a reclining adult user's entire body without said top wall itself providing any support to any portion of such a reclining adult user's body to thereby provide an adult user with a true flotation experience; whereby when said mattress is contained within a generally rectilinear support structure having a substantially planar bottom and is filled with confined liquid to its effective depth, and an adult user reclines on said top wall, a sufficient amount of said top wall is displaced by such an adult user's body to in turn displace a volume of liquid within said mattress which will be equal to such an adult user's weight so that such an adult user will experience a true, body flotation experience without said top wall of the mattress or any portion of a support structure for the mattress providing any support to any portion of such an adult user's body, and wherein further an adult user's movement, will not be restricted by said mattress and will not be restricted by any portion of such a support structure.

2. The confined liquid mattress of claim 1 in which said mattress is filled with liquid having a specific gravity of about 1.0 or more.

3. The confined liquid mattress of claim 2 in which said mattress is intended to be used by a single user and wherein said top wall has an effective length at least about 15 inches (38 cm) greater than the effective length of said bottom wall and an effective width at least about 12 inches (30.5 cm) greater than said bottom wall, and the sum of the excess length and the excess width of the top wall is at least about 24 inches (71 cm).

4. The confined liquid mattress of claim 2 in which said mattress is intended to be used by two users and wherein said top wall has an effective length at least about 12 inches (30.5 cm) greater than the effective length of said bottom wall and an effective width at least about 24 inches (71 cm) greater than the effective width of said bottom wall, and the sum of the excess length and the excess width of the top wall is at least about 36 inches (101.5 cm).

5. The confined liquid mattress of claim 1 in which said mattress is filled with liquid having a specific gravity of about 1.0 or more.

6. The confined liquid mattress of claim 1 in which said mattress is intended to be filled with liquid having a specific gravity of about 1.25 or more.

7. The confined liquid mattress of claim 6 in which said mattress is intended to be used by a single user and wherein said top wall has an effective length at least about 10.9 inches (27.7 cm) greater than the effective length of said bottom wall and an effective width at least about 10.9 inches (27.7 cm) greater than said bottom wall, and the sum of the excess length and the excess width of the top wall is at least about 21.8 inches (55.4 cm).

8. The confined liquid mattress of claim 6 in which said mattress is intended to be used by two users and wherein said top wall has an effective length at least about 10.9 inches (27.7 cm) greater than the effective length of said bottom wall and an effective width at least about 21.8 inches (55.4 cm) greater than the effective width of said bottom wall.

9. The confined liquid mattress of claim 1 in which said mattress is filled with liquid having a specific gravity of about 1.25 or more.

10. The confined liquid mattress of claim 1 in which said mattress is filled with liquid having a specific gravity of about 2.0 or more.

11. The confined liquid mattress of claim 10 in which said mattress is intended to be used by a single user and wherein said top wall has an effective length at least about 6.0 inches (15.25 cm) greater than the effective length of said bottom wall and an effective width at least about 6.0 inches (15.25 cm) greater than said bottom wall.

12. The confined liquid mattress of claim 10 in which said mattress is intended to be used by two users and wherein said top wall has an effective length at least about 6.0 inches (15.25 cm) greater than the effective length of said bottom wall and an effective width at least about 12 inches (30.5 cm) greater than the effective width of said bottom wall.

13. The mattress of claim 1 in which the effective depth of the mattress is in the range of about 8 to about 10 inches (20.3 to 25.4 cm).

14. The mattress of claim 1 including a frame around said sidewalls of the mattress.

15. The mattress of claim 14 wherein the height of said frame is at least as high as the effective depth of said mattress.

16. The confined liquid mattress of claim 1 in which, said mattress includes liquid enclosed within said mattress in a manner to substantially fill the volume defined by said bottom wall and said side walls, without substantially extending said top wall so that there is substantially no air enclosed within said bladder.

17. The mattress of claim 1 wherein a top sheet extends at least over the central portion of said top wall, said top sheet being attached to said top wall.

18. The mattress of claim 17 wherein said sheet is attached to said mattress with fastening means selected from the group consisting of hooks and loops, snaps, buttons, and ties.

19. The confined liquid mattress of claim 18 wherein said fastening means is hook and loops.

* * * * *